United States Patent [19]

Ferguson

[11] 4,341,270

[45] Jul. 27, 1982

[54] DRILL STRING SUSPENSION TOWER

[75] Inventor: Scott M. Ferguson, San Francisco, Calif.

[73] Assignee: Great American Development Co., San Francisco, Calif.

[21] Appl. No.: 160,048

[22] Filed: Jun. 16, 1980

[51] Int. Cl.[3] ..... B23Q 5/00; E21C 5/00; B23B 5/027

[52] U.S. Cl. ..... 173/151; 254/386

[58] Field of Search ..... 173/151; 254/277, 386, 254/265

[56] References Cited

U.S. PATENT DOCUMENTS

| | | | |
|---|---|---|---|
| 1,810,246 | 6/1931 | Jones | 173/151 X |
| 3,502,535 | 3/1970 | Bongers et al. | 254/386 X |
| 3,986,564 | 10/1976 | Bender | 173/151 X |
| 4,170,340 | 10/1979 | Mouton | 254/386 |

*Primary Examiner*—Ronald Feldbaum

*Attorney, Agent, or Firm*—Townsend and Townsend

[57] ABSTRACT

Improved means for suspending a drill string using a pair of hydraulically actuated belts is disclosed. A derrick or tower is mounted to a base to overlie a standard rotary drill table. The drill string (comprising a number of drill pipes and a drill collar) and a drill bit are suspended within the hole being drilled by a hook. A hook support rides between a pair of vertical guide rails and supports the hook between the rails via a pair of belts which engage the hook support. The belts extend from the hook support, to the stationary pulleys at the top of the tower, and down to an alternating series of stationary and movable pulleys which define a variable length path along which the belts are guided. When it is desired to raise or lower the hook, and therefore the drill string therefrom, the hydraulically actuated, movable pulleys are either raised or lowered to change the length of the variable length path and consequently the length of belt along the path.

16 Claims, 4 Drawing Figures

DRILL STRING SUSPENSION TOWER

This invention is related to drill rigs, particularly one having an improved hydraulically actuated drill string suspension means.

BACKGROUND OF THE INVENTION

Oil wells are generally produced using a rotary drill to make the hole. The drilling rig typically consists of a base upon or over which a derrick or tower rests. In the rotary drilling method, a drill bit is attached at the end of a string of drill pipes. This drill string is rotated causing the bit to bore into the earth to produce the hole. Oil drilling operations use drill pipes which are typically 30 feet long and about 5 inches in diameter. They are joined to one another by heavy pipe threads. The pipe just above the drill bit is much heavier than the other pipes and is called a drill collar. The drill collar is used to supply the proper amount of force onto the drill bit for drilling.

The drill string is pendulously supported by a movable hook mounted within the tower so that the total weight of the drill string does not bear upon the drill bit. The force on the bit is therefore independent of the length of the drill string but is generally determined by the weight of the collar. Without such support the weight of the entire drill string, which can easily exceed several hundred tons, would ruin the drill bit. Therefore it is possible for the drill bit to exert downward pressure on the earth being bored while essentially the entire drill string is being pendulously supported by the hook because of the great lengths and weights involved and the elasticity of the materials used. An analogous example would be to hold over a table one end of a rubberband which has a lead weight attached to the opposite end. By allowing the lead weight to just touch the table top, the lead weight partially bears against the surface; however the weight of the rubberband, as well as a portion of the weight of the lead weight, is supported by the person holding the rubberband and not by the surface.

The drill string is rotated by a rotary drill table mounted on the base. The rotary drill table engages a typically square or hexagonal cross-sectional pipe, known as a kelly, to turn the drill string. Most of the prior art drilling rigs support the hook within the tower by a block and tackle cable system actuated by a winch. As drilling progresses, the winch pays out cable allowing the hook to descend, thus allowing the kelly to slide through a complementarily shaped hole in the rotary drill table. When the top of the kelly is near the rotary drill table, the drill string is wedged into place, the kelly is disconnected from the top drill pipe, and a new length of drill pipe is added to the string. The kelly is then reconnected to the top of the new drill pipe and the hook is attached to the kelly after sufficient cable has been rewound on the winch thus resuspending the drill string. Drilling operations can then resume.

This sequence will be repeated over 600 times for a 20,000 foot well. Further, when the drill bit becomes dull, the entire drill string must be removed to replace it. Thus the cable must be payed out and taken up on the winch a great number of times when drilling a single hole.

One problem with the above described winch, block and tackle suspension arrangement is that the cable is always under tension and that it is wound on rewound on the winch hundreds of times while drilling a well. The brakes and clutch on the winch wear out relatively quickly under such conditions. Also the likelihood of cable failure is great because of these operational demands. Because the cable is wound on the winch, it cannot easily be inspected. It is unfortunately not surprising that a primary cause of accidental deaths in drilling operations is due to a cable breaking during the operations. The resulting ends of the cables, because of the great stress to which they were subjected, whip around in an unpredictable manner with great force and cause great destruction to anything in their path.

Another problem is a result of the block and tackle apparatus situated at the top of the tower. These multiple lines and pulleys occupy a great amount of space on the tower and interfere with the ease of mounting and dismounting the drill pipes to and from the drill string.

The following U.S. Patents may be of interest to the reader: U.S. Pat. Nos. 3,273,861 and 3,502,535.

SUMMARY OF THE INVENTION

The drill rig includes a base upon which derrick or tower is situated. A standard rotary drill table is also located on the base generally coaxial with the tower. The drill string, comprising a number of drill pipes and the drill collar, and a drill bit, attached at the end of the drill string to the drill collar, are suspended within the hole being drilled by a hook. The hook is attached to a movable hook support which rides within a pair of vertical guide rails. The hook support and hook therewith are supported by a pair of movable belts. The belts are routed around stationary pulleys at the top of the tower down to a series of alternating stationary and hydraulically actuated movable pulleys. The stationary and movable pulleys are located on the base adjacent to the tower and define a variable length path. When it is desired to raise or lower the hook, and therefore the drill string and bit suspended therefrom, the hydraulically actuated, movable pulleys are either raised or lowered to change the length of the variable length path thus causing the belt passing therealong to be taken up or payed out.

A primary advantage of the present invention is that it enhances the safety of the workers at the drill rig for several reasons. First, the belt can be made much stronger than a braided wire having similar flexibility. Second, the belt is never wound around a spool, therefore it never undergoes twisting or other contorsions which may occur with the winching, block and tackle cable arrangement of the prior art drill string suspension apparatus. Further, the entire belt, whether it be a continuous belt or a dead-end belt, is visible for inspection at all times—unlike cables which are wound around a take-up spool on a winch. Further, belts can be manufactured so if they do break, they don't exhibit the whip-like flailing action of a severed cable. Therefore, the use of a belt results in a much greater degree of safety for the workers.

The hydraulically actuated pulleys also offer a greater degree of control compared to prior art. The hydraulic cylinders can be precisely positioned in minute increments and precisely operated over a great range of forces and speeds. The problem of worn out brakes or clutches is not present with the hydraulic actuators. The invention also allows remote operation of the cable take-up assembly whereas with prior art winch-type cable take-up apparatus, the operator was generally required to be physically present at the winch to ensure its proper operation. Therefore, if something does go wrong, the operator of the present invention can be at a safe distance.

Additional features and advantages of the invention will appear from the following description in which the preferred embodiment has been set forth in detail in conjunction with the accompanying drawings.

DETAILED DESCRIPTION OF THE PREFERRED EMBODIMENT

Figure 1:
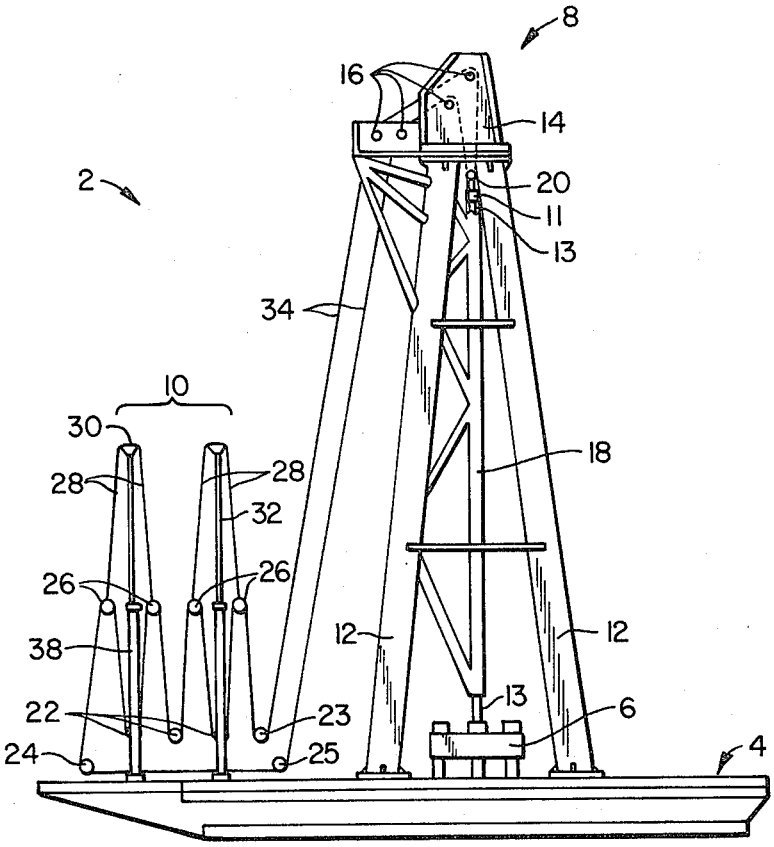
FIG. 1 is a side view of a drill rig incorporating the drill string suspension tower of the present invention.

Turning our attention to FIG. 1, a movable drill rig 2 is shown including a base 4, a rotary drill table 6 mounted centrally upon the base, a derrick or tower 8 mounted to the base immediately above the drill table and a belt take-up assembly 10 mounted to the base adjacent to the tower. It should be noted that this invention relates primarily to the apparatus which supports a hook 11 used to support a drill string 13 (which is the series of drill pipes joined together) passing through the rotary drill table and down into the well.

Figure 2:
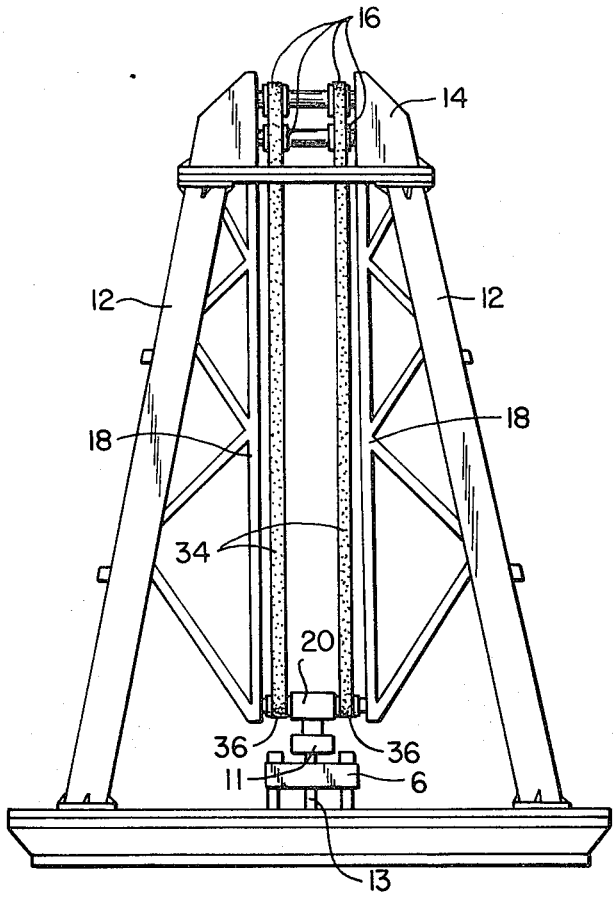
FIG. 2 is a front view of the tower of the present invention showing the movable hook support at its lowest position.

Turning now to FIGS. 1 and 2, the tower is an A-frame type structure having four legs 12 mounted to the base at their lower ends and to a crown block 14 at their upper ends. The crown block supports several stationary guide pulleys 16. A pair of guide rails 18 are fixed generally centrally above the rotary drill table and are adapted to guide a movable hook support 20 therealong. The hook is attached to the central portion of hook support 20.

Belt take-up assembly 10 is mounted to the base adjacent to the tower. Stationary pulleys 22, 23, 24, 25 are mounted in fixed positions near the base while movable pulleys 26 are mounted between stationary pulleys 22, 23 and 24. The stationary pulleys are mounted to the base in a conventional manner, however such supports are not shown in the figures for clarity. Pulleys 22–24, 26 define a variable length path over which belts 34 pass. If desired all of the pulleys defining the variable length path may be movable pulleys. The movable pulleys are supported by lines 28 attached to the upper ends 30 of hydraulic cylinder rods 32. A pair of belts 34 are wound in a continuous loop around pulleys 16, 22–26, to engage hook support pulleys 36 mounted at either end of hook support 20.

Figure 3A:
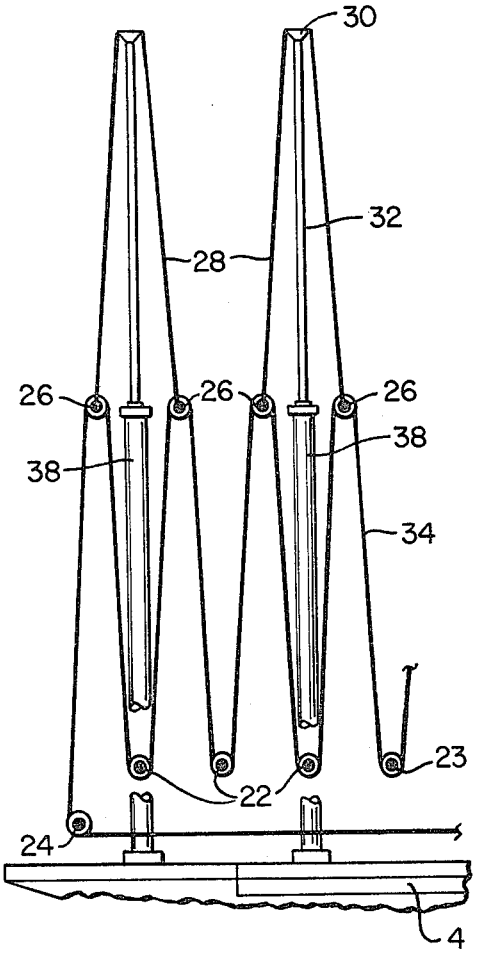
FIGS. 3A and 3B are simplified representations of the hydraulically actuated cable take-up assembly in its upper and lower positions, respectively.
Figure 3B:
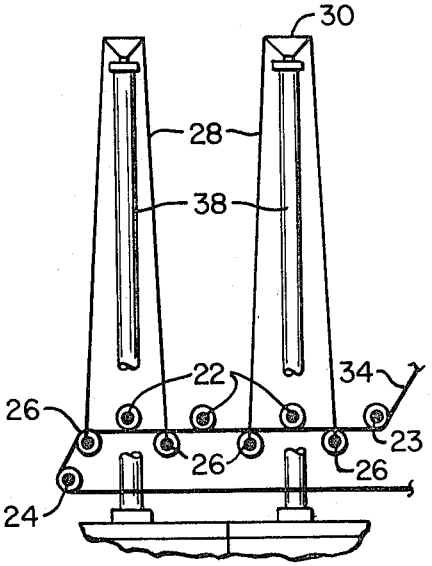

Turning to FIGS. 3A and 3B it will be apparent how the actuation of hydraulic cylinders 38 causes the variable length path to lengthen or shorten thus raising or lowering hook support 20. In FIGS. 1 and 3A, movable pulleys 26 are shown in their uppermost positions thus causing the belts to follow a serpentine path around the pulleys to effect take-up of the belts. This causes hook support 20 to assume a position between the guide rails adjacent to the crown block of the tower as shown in FIG. 1. FIG. 3B illustrates movable pulleys 26 in their lowermost positions adjacent to the base of the drill rig. In this position the belts follow a relatively straight, short path around the pulleys. The corresponding position of the hook support of the lower end of the guide rails is shown in FIG. 2. Of course, any intermediate position is also available through the selective activation of the hydraulic cylinder rods.

The procedure for using the present invention in conjunction with the other drilling apparatus proceeds generally as follows. A drill bit, a drill collar, one or more drill pipes, and a kelly are mounted within the tower to pass through the rotary drill table. The drill string, comprising the drill collar, the drill pipes and the kelly at the top, is suspended from the hook, the hook attached to movable hook support 20. As the drill bores into the earth, pipes are added to the drill string in the usual fashion. It should be remembered that the drill string is pendulously suspended from the hook and is thus supported by and axially positioned by the apparatus of the present invention. As the drilling takes place, the upper ends of the hydraulic cylinder rods are lowered at a controlled rate depending upon the hardness of the material being drilled. This causes the variable length path to shorten thus lowering the hook support and hook. When the drill bit has progressed a sufficient distance, typically the length of a drill pipe, the drill string is wedged in place, the kelly is removed, the hook is raised by extending the upper ends of the hydraulic cylinder rods upwardly, a new drill pipe is mounted on the upper end of the drill string, the kelly is mounted to the upper end of the new drill pipe, and the hook is attached to the upper end of the kelly. Drilling can then recommence.

In the embodiment shown, a pair of belts 34 and two hydraulic cylinders 38 are used. If desired, a greater or fewer number of belts or hydralic cylinders can be employed. If desired a pair of belts can be used having one belt extend from one side of the tower and the other belt extend from the opposite side of the tower in order to reduce the bending stresses on the tower. Also the belts may be dead-ended, rather than being a continuous loop as shown.

Although the present invention is shown mounted to a unitary base, such is not required. However, mounting belt take-up assembly 10 and tower 8 to the base facilities rapid deployment in the field because spacing and alignment between assembly 10 and tower 8 is prearranged. Further, forces produced by the suspended drill string as well as rotary forces produced at the rotary drill can be transmitted to the ground over a wide area through the base.

It will be appreciated that modification and revision may be made to the embodiment described above without departing from what is regarded to be the present invention.

What is claimed is:

1. A drill string suspension apparatus for use in conjunction with a hook supporting said drill string during well drilling operations, comprising:

(a) a generally vertically extending frame;

(b) means for movably supporting said hook along a first path within said frame, said first path being generally coaxial with said drill string;

(c) a belt coupled to said movable support means and adapted for raising and lowering said movable support means and said drill string attached thereto along said first path; and (d) a belt take-up assembly operably coupled to said supporting means via said belt, said take-up assembly comprising:

(i) at least two belt guiding means, at least one of which is movable relative to the other belt guiding means, said belt guiding means adapted to guide the belt along a second, variable length path; and (ii) means for changing the relative positions of said belt guiding means so the length of said belt passing along said second variable length path is changed thereby causing the position of said hook along said first path to change.

2. The apparatus of claim 1 wherein said belt has a relatively flat surface.

3. The apparatus of claim 1 wherein said frame includes means for guiding said supporting means along a portion of said first path.

4. The apparatus of claim 3 wherein said guiding means includes a pair of guide rails disposed adjacent and parallel to a portion of said first path.

5. The apparatus of claim 1 wherein said frame includes means for directing said belt from said supporting means to said take-up assembly.

6. The apparatus of claim 1 wherein said belt guiding means are rotatable belt guiding means configured to rotatably engage said belt.

7. The apparatus of claim 1 wherein said relative position changing means includes at least one hydraulic piston operably coupled to said at least one said belt guiding means.

8. The apparatus of claim 1 wherein there is one continuous-loop belt.

9. The apparatus of claim 7 wherein there are at least four movable belt guiding means alternatingly positioned between at least four fixed belt guiding means, said movable belt guiding means operably coupled to at least two hydraulic pistons.

10. A drill rig comprising:

(a) a drill table;

(b) a generally vertically extending tower mounted over said drill table;

(c) a hook for supporting the upper end of a drill string extending within a bore to be drilled within the ground; and (d) means for movably supporting said hook and the end of said drill string therewith along a first path, said first path being within said tower and generally coaxial with the upper end of said bore, said supporting means further comprising:

(i) a belt operably coupled to said hook;

(ii) at least two means for guiding said belt along a second, variable-length path so that as the length of said second path changes, the length of said belt along said path changes thus changing the position of said hook along said first path; and (iii) means for displacing at least one said guiding means thereby changing the length of said second path and the position of said hook along said first path.

11. The drill rig of claim 10 wherein said belt is generally flat.

12. The drill rig of claim 10 further comprising means for routing said belt from said tower to said guiding means.

13. The drill rig of claim 10 further comprising means adjacent said first path for guiding said hook along said first path.

14. The drill rig of claim 10 wherein said belt is a continuous-loop belt.

15. The drill rig of claim 10 wherein:

said guiding means includes at least two stationary rollers and a movable roller, said rollers configured to rotatably engage said belt; and said displacing means includes a hydraulic piston operably connected to said movable roller.

16. A drill string suspension apparatus for use in conjunction with a hook supported said drill string during well drilling operations, comprising:

a generally vertically extending frame;

a movable hook support to which said hook is removably attached;

means for guiding said hook support along a first path within said frame, said first path being generally coaxial with said drill string;

a relatively flat belt operably coupled to said movable hook support;

a belt take-up assembly located near said frame and operably coupled to said hook support via said belt, said belt take-up assembly comprising: a movable, rotatable belt guiding means; a fixed rotatable belt guiding means, said movable and fixed rotatable belt guiding means adapted to guide said belt along a second, variable length path, and means for hydraulically displacing said movable rotatable belt guiding means so that the length of said belt passing along said second variable length path is changed thereby causing the position of said hook along said first path to change; and means for directing said belt from said hook support to said take-up assembly.

* * * * *